US005855524A

United States Patent [19]

Jenkins

[11] Patent Number: 5,855,524

[45] **Date of Patent: *Jan. 5, 1999**

[54] LONG HANDLED CHIPPER

[76] Inventor: Robert E. Jenkins, 2904 Hillview, Austin, Tex. 78703

[ * ] Notice: This patent issued on a continued prosecution application filed under 37 CFR 1.53(d), and is subject to the twenty year patent term provisions of 35 U.S.C. 154(a)(2).

[21] Appl. No.: 792,639

[22] Filed: Jan. 31, 1997

[51] Int. Cl.[6] ..... A63B 53/00; A63B 53/04

[52] U.S. Cl. ..... 473/294; 473/313; 473/409; 473/328

[58] Field of Search ..... 473/294, 293, 473/306, 325, 243, 409, 313–314, 328, 340

[56] References Cited

U.S. PATENT DOCUMENTS

| | | | |
|---|---|---|---|
| D. 137,283 | 2/1944 | Jakosky . | |
| D. 179,246 | 11/1956 | Gillion . | |
| 1,618,638 | 2/1927 | Coles . | |
| 3,416,798 | 12/1968 | Pennington . | |
| 3,497,220 | 2/1970 | Scott | 473/313 |
| 3,679,207 | 7/1972 | Florian | 473/294 |
| 4,111,426 | 9/1978 | Goodwin | 473/306 |
| 4,163,554 | 8/1979 | Bernhardt . | |
| 4,512,583 | 4/1985 | de VIlmorin . | |
| 4,592,552 | 6/1986 | Garber | 473/294 |
| 4,621,816 | 11/1986 | Leek | 473/293 |
| 4,921,253 | 5/1990 | Tesori | 473/341 |
| 4,964,639 | 10/1990 | Tucker | 473/293 |
| 5,125,657 | 6/1992 | Beil | 473/294 |
| 5,188,361 | 2/1993 | Coombe | 473/294 |
| 5,275,409 | 1/1994 | Currie | 473/306 |
| 5,320,346 | 6/1994 | Phillips . | |
| 5,458,335 | 10/1995 | Hattori . | |
| 5,538,245 | 7/1996 | Moore . | |
| 5,544,879 | 8/1996 | Collins . | |
| 5,547,196 | 8/1996 | Izett . | |
| 5,584,769 | 12/1996 | Sundin | 473/325 |

*Primary Examiner*—Sebastiano Passaniti
*Attorney, Agent, or Firm*—G. Turner Moller

[57] ABSTRACT

A long handled chipper allows a golfer with the yips to chip better. In one embodiment, a plurality of club faces having different degrees of loft are provided so the club may be used for different purposes, e.g. as a chipper and as a putter.

4 Claims, 1 Drawing Sheet

LONG HANDLED CHIPPER

This invention relates to a golf club and more specifically to a long handled chipper which a golfer uses around the green.

BACKGROUND OF THE INVENTION

Golfers abilities wane with age and those have reached a certain age almost always acquire an affliction known among golfers as the yips. The yips is an inability to swing a putter as smoothly as in younger days and is thought to be of neuromuscular origin, associated with a decreased ability to control small muscles. Although it is common among older golfers, the yips can be acquired at surprisingly early ages. Until it happens, golfers usually believe this is an ailment of someone else.

The yips come in degrees of seriousness. In moderate cases, there is an inability to swing the putter smoothly. In some moderate cases, instead of the putter head swinging back smoothly and then swinging smoothly toward the ball, the putter head jerks backwards, usually off its intended line, and the actual forward stroke is something quite different from what was intended. After the putter head jerks backwards, all is lost and, if the ball actually rolls into the hole, it is pure luck. In other moderate cases, the putter head swings back smoothly but then jerks forwardly, off its intended line. Again, all is lost. Because there are so many individual variations and permutations, the reactions of any particular player will normally be unlike that of the next.

In more aggravated cases, there is almost an inability to bring the putter back. Some people are so bothered by the yips that it affects other easy or soft shots.

There have been many approaches to minimize the yips in an attempt to swing the putter head more smoothly. Bernard Langer is known for a putting grip in which the left hand grips the club and the right hand clamps the left forearm to the putter shaft. Sam Snead attempted to putt croquet style, i.e. astride the intended path of ball movement, and found it was illegal. Long handled putters are widely used by those with the yips or by those willing to try something different in an attempt to putt better.

A typical or standard set of golf clubs has the specifications shown in Table I:

TABLE I

| club | shaft length | lie angle, degrees | loft angle, degrees |
|---|---|---|---|
| driver | 41–45" | 55 | 7–13 |
| 2 wood | | 56 | 11–17 |
| 3 wood | | 56 | 13–18 |
| 4 wood | | 56 | 16–20 |
| 5 wood | | 57 | 18–23 |
| 1 iron | | 56 | 15–16 |
| 2 iron | 36–39" | 57 | 17–18 |
| 3 iron | | 58 | 19–20 |
| 4 iron | | 59 | 23–24 |
| 5 iron | | 60 | 26–28 |
| 6 iron | | 61 | 30–32 |
| 7 iron | | 62 | 34–36 |
| 8 iron | | 63 | 38–40 |
| 9 iron | | 64 | 42–44 |
| pitching wedge | | 64 | 46–48 |
| sand wedge | | 65 | 53–55 |
| putter | 30–40" | 72 | 2–4. |

The lie angle is the angle between the shaft and the ground, or between the shaft and the sole of the club, at the ball address position. The loft angle is the angle between the club face and a vertical plane extending through the club face at the ball address position, usually at the front edge of the club face. The ball address position is the position of the club head immediately behind the ball when the player takes a normal stance in preparation to strike the ball.

Disclosures of interest relative to this invention are found in U.S. Pat. Nos. D137,283; D179,246; 1,618,638; 3,416,798; 4,163,554; 4,512,583; 5,320,346; 5,458,335; 5,538,245; 5,544,879 and 5,547,196.

SUMMARY OF THE INVENTION

This invention comprises a long handled chipper, i.e. a club having a long shaft, like a long handled putter, but equipped with a club head having at least one ball striking face of substantial loft. The idea is that people suffering a major case of the yips may chip using the pendulum motion analogous to a long handled putter, allowing the use of a slightly different set of muscles than conventional chipping. Swinging a long handled chipper of this invention is not identical to putting with a long handled putter because the ball has to be struck considerably more firmly, which requires a longer backswing, more effort delivered on the downswing or a combination of both, depending on the talent and technique of the player.

One thing that differentiates a long handled chipper from other long shafted clubs is the lie angle that the shaft makes with the ground. There are long shafted drivers that are quite long. For example, Emilee Kline presently uses a 50" driver even though she is only 5'3" tall. Because the driver is swung in a large arc which is relatively flat to the ground, the lie angle is the smallest of all clubs. In contrast, the lie angle of the chipper of this invention is comparable to the lie angle of long handled putters, i.e. vertical or nearly so.

In this invention, the overall length of the club is at least 40" and is preferably in the range of 40–60". The shaft of the club is perpendicular, or nearly so, to the sole of the club face at the address position and has a lie angle of 78°–90°. The loft of the long handled chipper of this invention is in the range from a four iron to a 65° wedge and thus is in the range of about 23°–65°. The long handled chipper of this invention may be made in left hand or right hand versions. One embodiment of this invention is inherently left handed and right handed.

To those afflicted with a serious case of the yips, the long handled chipper of this invention provides a means of chipping better for two reasons. First, the pendulum type swing of a long handled chipper is analogous to that of a long handled putter which has proven effective to overcome a case of the yips when putting. Second, the success of a long handled chipper of this invention increases because of the player's increased confidence in chipping with a club designed to minimize the effects of the yips.

Another feature of this invention is that the club preferably has a plurality of club faces so the club may be used for different functions. For example, one of the club faces may have a 7 iron loft and another club face may be a putter loft, i.e. not much loft at all, usually in the range of 0°–5°.

It is an object of this invention to provide a long handled chipper.

A more specific object of this invention is to provide a long handled chipper having a loft of between 23°–65° and an overall club length of at least 40" where the club has a lie angle of 78°–90°.

A further object of this invention is to provide a long handled chipper with a plurality of club faces so the same club can be used for different functions.

These and other objects and advantages of this invention will become more apparent as this description proceeds, reference being made to the accompanying drawings and appended claims.

DETAILED DESCRIPTION

Figure 1:
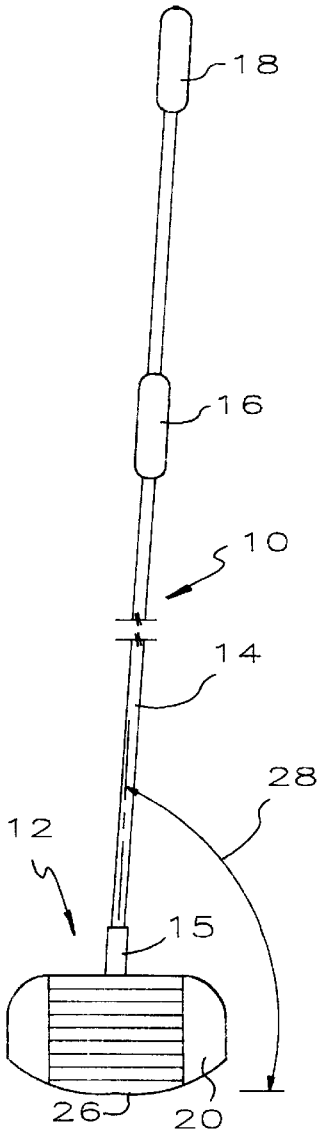
FIG. 1 is a front view of a simple right handed long handled chipper of this invention.
Figure 2:
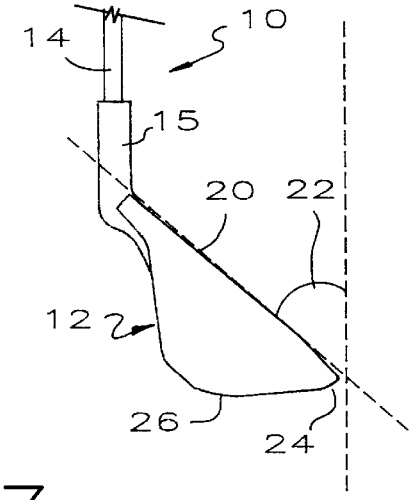
FIG. 2 is an end view of the club head of the long handled chipper of FIG. 1.

Referring to FIGS. 1–2, there is illustrated a simple right handed long handled chipper 10 of this invention comprising a club head 12, a shaft 14 and a two part grip 16, 18. A right handed player grips the upper grip 18 with the left hand and braces it against the player's chest or chin thereby substantially immobilizing the left hand against up-and-down movement and against back-and-forth movement, i.e. the left hand substantially only rotates about an axis. The lower grip 16 is grasped by the right hand and the club head 12 is swung backwards, pendulum like, about a relatively fixed point, i.e. the left hand. The player takes a backswing in accordance with his judgment of how hard he needs to hit the ball. The club head 12 is then swung forwards, pendulum-like, about the fixed left hand, striking the ball and propelling it upwardly off the underlying ground surface so the ball proceeds airborne part way toward the cup, producing a chip shot having a more-or-less conventional trajectory when compared to shots hit with conventional clubs having comparable lofts.

The club head 12 has a face 20 providing a loft desirable for chipping purposes. Loft is the angle 22 the club face 20 and a vertical plane at the ball address position, typically a vertical plane intersecting the lower edge 24 of the club face 20. For purposes of this invention, the loft of the club face 20 is in the range of 23°–65° which is basically the range of lofts from a four iron to a 65° pitching wedge.

The sole 26 of the club head 12 is preferably not flat but is slightly curved. Those skilled in the art will recognize that most irons have gently curved soles.

The shaft 14 is preferably of a sufficient length to provide the overall desired length of the chipper 10. Typically, the shaft 14 joins the club head 12 near the top center with or without a more-or-less conventional appearing hosel 15. In the address or ball address position, the shaft 14 is normally tilted slightly away from perpendicular to the ground because the player is standing on one side of the intended path of movement of the ball, rather than astride the intended path of movement. The angle 28 between the shaft 14 and a horizontal plane or, in practice, the ground at the ball address position, is known as the lie angle. The lie angle 28 in this invention is in the range of 78°–90° and depends on how long the chipper 10 is and how far away from the feet the player positions the ball. These variables are dictated by the height of the player, where the player braces the left hand, how close the ball is positioned to the player's feet and how much the player leans over the ball. Manifestly, if the player leans slightly over the ball, a long handled chipper with a shaft perpendicular to the club head is quite satisfactory.

Figure 3:
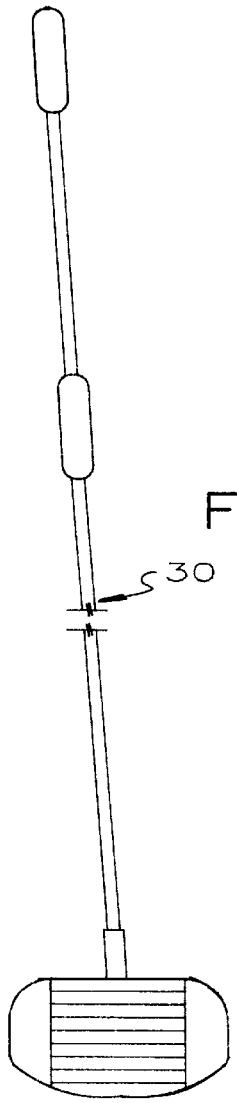
FIG. 3 is a front view of a simple left handed version of a long handled chipper of this invention.

Referring to FIG. 3, there is illustrated a long handled left handed chipper 30 of this invention which is a substantial mirror image of the right handed chipper 10.

Figure 4:
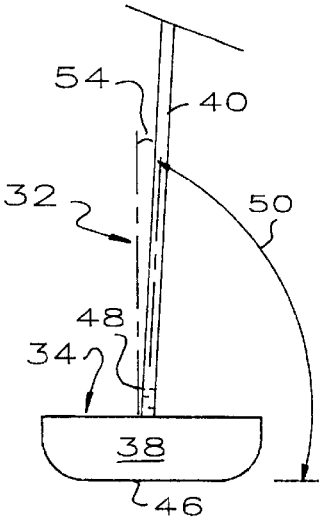
FIG. 4 is a front view of a combination golf club having club faces of different loft, illustrating a putter face but having a club face of substantial loft.
Figure 5:
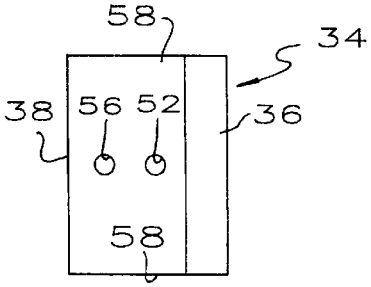
FIG. 5 is a top view of the club head of FIG. 4 showing two club faces having different lofts.

Referring to FIGS. 4–5, there is illustrated a right handed long handled chipper 32 comprising a club head 34 providing a chipper face 36 of substantial loft in the range of 23°–65° and a putter face 38 of minimum loft in the range of 0°–5°, a shaft 40 and a two part grip (not shown). The club head 34 provides a generally flat sole 46 so, in the ball address position, the sole 46 is substantially flat on the underlying ground surface. The shaft 40 includes a threaded or other releasable connection 48 on the lower end thereof and accordingly threadably connects to the club head 34. To provide the desired angle 50 between the shaft 40 and the ground surface at the ball address position, a threaded opening or other releasable connection 52, associated with the chipper face 36, is offset relative to the vertical by an angle 54 in the range of 0°–12° which is the complement of the lie angle 50. It will accordingly be seen that the shaft 40, at the ball address position, is offset to the vertical, by the another angle in the range 0°–12° which corresponds to a lie angle of 78°–90°. A second threaded opening or other releasable connection 56, associated with the putter face 38, is offset by another angle in the range of 0°–12°. When the player decides to chip with the long handled chipper 32, the shaft 40 is connected to the opening 52. After making the chip and needing to putt, the player disconnects the shaft 40 from the opening 52 and connects it to the opening 56.

One of the peculiarities of the club 32 is that the shaft 40 disconnected from the opening 52 and connected to the opening 56 in order to putt. Instead of using the club face 38 as the putter face, one of the side faces 58 may be used as a putter face without moving the shaft 40.

Figure 6:
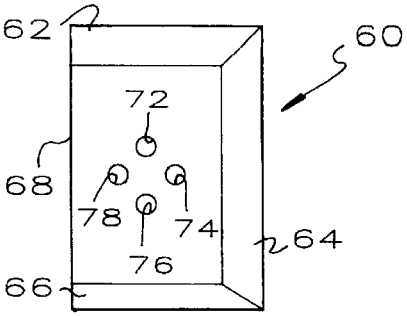
FIG. 6 is a top view of another embodiment of this invention illustrating a club head with four club faces.

Referring to FIG. 6, a generally square four faced long handle chipper club head 60 provides a series of chipper faces 62, 64, 66 all of which are different but all of which have lofts in the range of 23°–65°. A preferred selection might be a 5, 7 and 9 iron lofts. A putter face 68 having a loft in the range of 0°–5° may also be provided. Because the sole of the club head 60 is generally flat, a series of threaded openings or other releasable connections 72, 74, 76, 78 are provided, all of which are offset from the vertical, at the ball address position, at the same angle in the range of 0°–12°. It will be seen that use of the chipper club head 60 is the same as the chipper club head 34.

Figure 7:
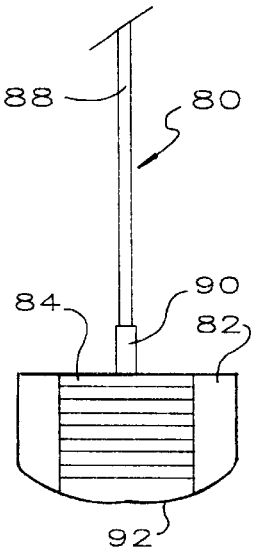
FIG. 7 is a first front view of a combination golf club having club faces of different loft, showing the ball address position with one of the club faces.
Figure 8:
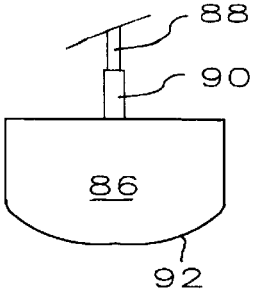
FIG. 8 is a second front view of the golf club of FIG. 7 showing the ball address position with another of the club faces.

Referring to FIGS. 7–8, a somewhat different two faced long handled chipper 80 is provided having a club head 82 having a chipper face 84 on one side and a vertical putter face 86 on the other. The chipper face 84 has a loft in the range of 23°–65° and the putter face 86 has a loft in the range of 0°–5° in accordance with this invention.

The chipper 80 includes a shaft 88 permanently connected to the club head 82 in any suitable manner, as by a conventional hosel 90. The shaft 88 is perpendicular to the club head 82 which has a noticeably rounded sole 92. The concept is that a right handed player, for example, may tilt the shaft 88 to a desired swing plane, offset from the vertical, as is allowed by the rounded sole 92 and chip with the chipper face 84. When the time comes to putt, the player turns the club around and tilts the shaft 88, as allowed by the rounded sole 92, to a desired lie angle in the range of 78°–90°. The concept of using a rounded sole as a means of allowing tilting of the shaft works equally well with a four sided club head, such as the club head 60.

It is recognized there is a different between chipping and pitching a golf ball. Chipping usually implies a relatively low shot that is airborne part way to the pin but which rolls a substantial distance. Pitching usually implies a much more lofted club where the shot is airborne almost all the way to the pin and which stops abruptly, either because of back spin on the ball or because the high ball trajectory tends to land softly and not roll much. As used herein, chipping is intended to include both low trajectory chip shots that roll a long way and high angle pitch shots that do not roll very much after landing.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A golf club comprising a long handled chipper for assisting a golfer to chip a golf ball along an intended path of movement, including a shaft having a grip at a first end;

only one club head at a second end, the club head having only one ball striking face, the face providing a loft angle in the range of about 23°–65°;

the lie angle between the shaft and an underlying ground surface in a ball address position by a person standing on one side of the intended path of movement being 78°–90°;

the overall length of the golf club being at least forty inches, whereby the golfer grips the shaft at a point with one hand and swings the club in a pendulum fashion about the point with another hand.

2. The golf club of claim 1 wherein the club head provides a rounded sole, the rounded sole allowing positioning of the shaft, at the ball address position, offset from the vertical at an angle in the range of 0°–12°.

3. A method of chipping a golf ball toward a green using a golf club comprising a long handled chipper for assisting a golfer to chip a golf ball along an intended path of movement, including a shaft having a grip at a first end; only one club head at a second end, the club head having only one ball striking face providing a loft angle in the range of about 23°–65°; the lie angle between the shaft and an underlying ground surface in a ball address position by a person standing on one side of the intended path of movement being 78°–90°; the overall length of the golf club being at least forty inches, the method comprising steps for chipping the ball including placing the lofted club head behind the ball;

holding the grip with a first hand and substantially preventing up-and-down movement of the first hand;

grasping the club with a second hand substantially below and out of contact with the first hand;

swinging the lofted club head backward away from the ball in an arc having the first hand as a center of movement;

swinging the lofted club head forwardly toward the ball; and striking the ball with the lofted club head and propelling the ball upwardly out of contact with an underlying ground surface.

4. A method of chipping a golf ball toward a green using a golf club comprising a long handled chipper for assisting a golfer to chip a golf ball along an intended path of movement, including a shaft having a grip at a first end; only one club head at a second end, the club head having only one ball striking face providing a loft angle in the range of about 23°–65°; the lie angle between the shaft and an underlying ground surface in a ball address position by a person standing on one side of the intended path of movement being 78°–90°; the overall length of the golf club being at least forty inches, the method comprising steps for chipping the ball including placing the lofted club head behind the ball;

holding the grip with a first hand and substantially preventing up-and-down movement of the first hand;

grasping the club with a second hand substantially below and out of contact with the first hand;

swinging the lofted club head in a pendulum fashion away from the ball and then toward the ball; and striking the ball with the lofted club head and propelling the ball upwardly out of contact with an underlying ground surface.

* * * * *